US009056703B2

(12) United States Patent
Brown et al.

(10) Patent No.: US 9,056,703 B2
(45) Date of Patent: Jun. 16, 2015

(54) CONTAINER, A CLOSURE FOR A CONTAINER, AND A BASE FOR A CONTAINER

(75) Inventors: R. Stephen Brown, Kingston (CA); Eric Marcotte, Kingston (CA); Doug Wilton, Kingston (CA); Peter Gallant, Kingston (CA); David Robinson, Little Kimble (GB); Les Stokes, London (GB); Peter Holdcroft, Berkhamsted (GB); Matthew Miles, Berkamstead (GB); Simon Wilkinson, Berkhamsted (GB); Lee Underwood, High Wycombe (GB)

(73) Assignees: QUEEN'S UNIVERSITY AT KINGSTON, Kingston, ON (CA); PATHOGEN DETECTION SYSTEMS, INC., Kingston, ON (CA)

( * ) Notice: Subject to any disclaimer, the term of this patent is extended or adjusted under 35 U.S.C. 154(b) by 0 days.

(21) Appl. No.: 13/703,474

(22) PCT Filed: Jun. 17, 2011

(86) PCT No.: PCT/CA2011/000716

§ 371 (c)(1), (2), (4) Date: Mar. 1, 2013

(87) PCT Pub. No.: WO2011/156912

PCT Pub. Date: Dec. 22, 2011

(65) Prior Publication Data

US 2013/0177937 A1 Jul. 11, 2013

Related U.S. Application Data

(60) Provisional application No. 61/356,364, filed on Jun. 18, 2010.

(51) Int. Cl.

| | |
|---|---|
| ***B65D 55/02*** | (2006.01) |
| ***B01L 3/00*** | (2006.01) |
| ***B65B 5/08*** | (2006.01) |
| ***B65B 7/28*** | (2006.01) |
| ***B65D 3/14*** | (2006.01) |
| ***B65D 43/22*** | (2006.01) |

(52) U.S. Cl.

CPC ..... *B65D 55/02* (2013.01); *B01L 3/508* (2013.01); *B01L 2200/141* (2013.01); (Continued)

(58) Field of Classification Search

CPC ..... B65D 55/024; B65D 3/14; B65D 43/22; B65D 55/02; B01L 2200/141; B01L 2300/043; B01L 3/508; B65B 5/08; B65B 7/28

USPC ..... 422/500, 501, 68.1

See application file for complete search history.

(56) References Cited

U.S. PATENT DOCUMENTS 4,809,874 A * 3/1989 Pehr ..... 220/833
5,012,941 A * 5/1991 Abrams et al. ..... 215/250

(Continued)

FOREIGN PATENT DOCUMENTS

CA 2610284 1/2007

OTHER PUBLICATIONS

PCT International Search Report for PCT/CA2011/000716 dated Sep. 29, 2011.

*Primary Examiner* — Sam P Siefke

(57) ABSTRACT

A container, comprising: a body; and, a closure; wherein the closure has a lid hinged to a ring mounted on the body, the lid moveable from an open position to a closed position; wherein the lid has a tab hinged thereto for: inserting into and engaging a slot formed in the ring as the lid is moved to the closed position from the open position to thereby lock the lid in the closed position; or, receiving and engaging a pin head of a pin mounted on the ring in a hole formed in the tab to thereby hold the lid in the closed position, the pin configured to detach from the ring when the tab and lid are returned to the opened position.

20 Claims, 12 Drawing Sheets

(52) U.S. Cl.
CPC ..... *B01L 2300/043* (2013.01); *B65D 55/024* (2013.01); *B65B 5/08* (2013.01); *B65B 7/28* (2013.01); *B65D 3/14* (2013.01); *B65D 43/22* (2013.01)

(56) References Cited

U.S. PATENT DOCUMENTS 5,270,011 A * 12/1993 Altherr ..... 422/547
5,577,779 A * 11/1996 Dangel ..... 292/80
5,640,969 A * 6/1997 Davis ..... 600/584
5,685,444 A 11/1997 Valley
6,398,067 B1 * 6/2002 Belfance et al. ..... 220/833
6,772,902 B1 * 8/2004 White ..... 220/283
7,136,550 B2 * 11/2006 Mozdy ..... 385/28
7,537,935 B2 * 5/2009 Bienhaus et al. ..... 436/177
8,167,156 B2 * 5/2012 Milante ..... 215/217
8,807,359 B2 * 8/2014 Giraud et al. ..... 215/216
2005/0242105 A1 * 11/2005 Homann ..... 220/840
2009/0215150 A1 * 8/2009 Kane et al. ..... 435/243

* cited by examiner

CONTAINER, A CLOSURE FOR A CONTAINER, AND A BASE FOR A CONTAINER

This application claims priority from U.S. Provisional Patent Application No. 61/356,364, filed Jun. 18, 2010, and incorporated herein by reference.

FIELD OF THE INVENTION

This invention relates to the field of containers, and more specifically, to a container having a closure with tamper-indicating and locking mechanisms and a base for mating with test equipment.

BACKGROUND

Current containers for various substances such as test samples, beverages, foods, medicines and the like are provided with re-sealable closures. Such closures provide a benefit to the user in that the containers can be tightly sealed and resealed after opening. Although re-sealable containers provide benefits to users, by their nature they permit unauthorized and sometimes undetectable tampering with the substance. Accordingly, many containers include tamper-indicating closures, which are designed to make it apparent to a user that a container has been opened.

One problem with current tamper-indicating closures, such as tamper evident bands on soft drink bottle closures, is that they do not allow for secure locking of the container after an initial opening.

A need therefore exists for an improved container, a closure for a container, and a base for a container. Accordingly, a solution that addresses, at least in part, the above and other shortcomings is desired.

SUMMARY OF THE INVENTION

According to one aspect of the invention, there is provided a container, comprising: a body; and, a closure; wherein the closure has a lid hinged to a ring mounted on the body, the lid moveable from an open position to a closed position; wherein the lid has a tab hinged thereto for: inserting into and engaging a slot formed in the ring as the lid is moved to the closed position from the open position to thereby lock the lid in the closed position; or, receiving and engaging a pin head of a pin mounted on the ring in a hole formed in the tab to thereby hold the lid in the closed position, the pin configured to detach from the ring when the tab and lid are returned to the open position. The container may include a recess formed in a base of the body for mating the container with test equipment.

BRIEF DESCRIPTION OF THE DRAWINGS

Features and advantages of the embodiments of the present invention will become apparent from the following detailed description, taken in combination with the appended drawings, in which.

It will be noted that throughout the appended drawings, like features are identified by like reference numerals.

DETAILED DESCRIPTION OF THE EMBODIMENTS

In the following description, details are set forth to provide an understanding of the invention. In some instances, certain structures and techniques have not been described or shown in detail in order not to obscure the invention.

Figures 1, 2, 3, 4:
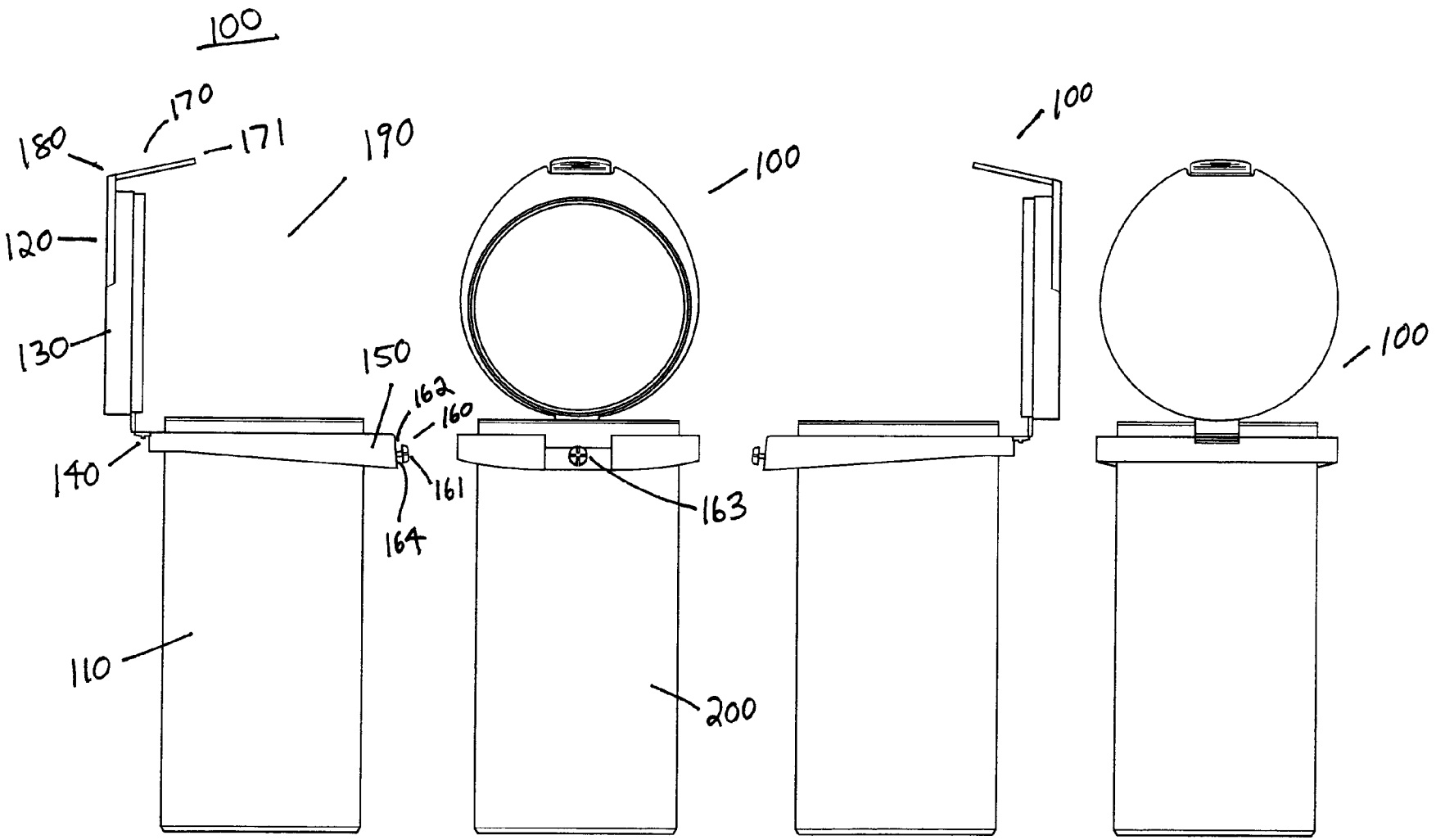
FIG. 1 is a left side view illustrating a container with its lid in an opened position with pin attached in accordance with an embodiment of the invention.
FIG. 2 is a front view illustrating the container of FIG. 1 in accordance with an embodiment of the invention.
FIG. 3 is a right side view illustrating the container of FIG. 1 in accordance with an embodiment of the invention.
FIG. 4 is a rear view illustrating the container of FIG. 1 in accordance with an embodiment of the invention.
Figure 5:
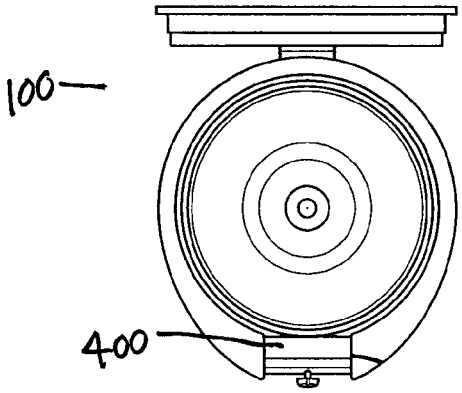
FIG. 5 is a top view illustrating the container of FIG. 1 in accordance with an embodiment of the invention.
Figure 7:
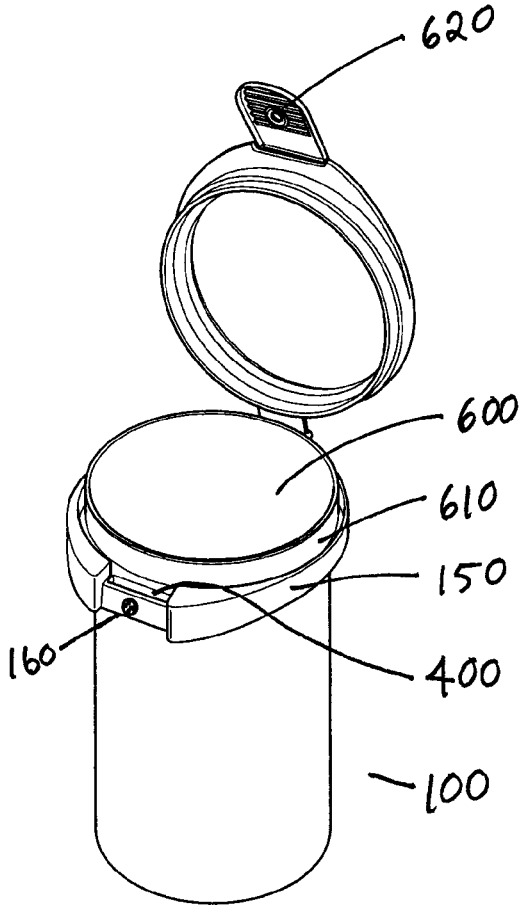
FIG. 7 is a top perspective view illustrating the container of FIG. 1 in accordance with an embodiment of the invention.
Figure 6:
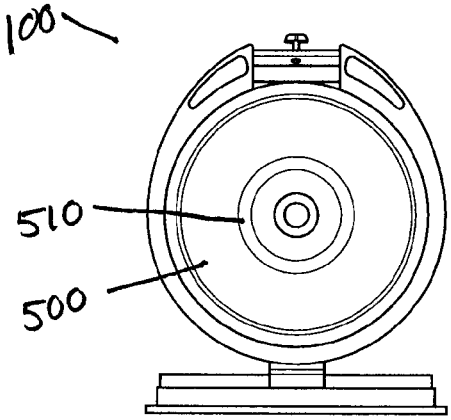
FIG. 6 is a bottom view illustrating the container of FIG. 1 in accordance with an embodiment of the invention.
Figure 8:
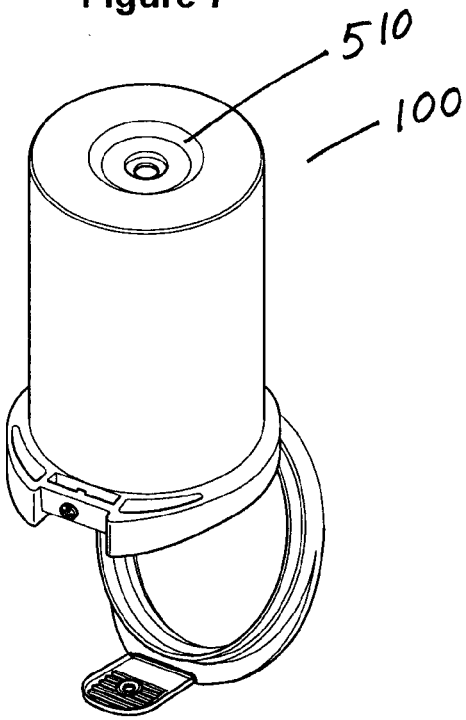
FIG. 8 is a bottom perspective view illustrating the container of FIG. 1 in accordance with an embodiment of the invention.

FIG. 1 is a left side view illustrating a container 100 with its lid 130 in an opened position 190 with pin 160 attached in accordance with an embodiment of the invention. FIG. 2 is a front view illustrating the container 100 of FIG. 1 in accordance with an embodiment of the invention. FIG. 3 is a right side view illustrating the container 100 of FIG. 1 in accordance with an embodiment of the invention. FIG. 4 is a rear view illustrating the container 100 of FIG. 1 in accordance with an embodiment of the invention. FIG. 5 is a top view illustrating the container 100 of FIG. 1 in accordance with an embodiment of the invention. FIG. 6 is a bottom view illustrating the container 100 of FIG. 1 in accordance with an embodiment of the invention. FIG. 7 is a top perspective view illustrating the container 100 of FIG. 1 in accordance with an embodiment of the invention. And, FIG. 8 is a bottom perspective view illustrating the container 100 of FIG. 1 in accordance with an embodiment of the invention.

According to one embodiment, the container (or cartridge or test cartridge) 100 includes a hollow container body 110 and a closure 120. The body 110 and closure 120 may be formed from a clear or opaque material such as glass, plastic, or metal. Plastics used may include polypropylene, polyethylene, polyamide including nylon and variations of nylon, blends, and copolymers of these. The closure 120 includes a lid 130 which is movably coupled by a hinge 140 to a ring or collar 150 mounted or formed on the body 110. The ring 150 couples the closure 120 to the body 110. The ring 150 may be a molded feature of the body 110 or may be integral with the body 110.

The body 110 is shaped to hold a liquid or solid substance. According to one embodiment, the substance may be a liquid to be tested. According to one embodiment, the body 110 may be cylindrical in shape having a side wall 200, a base 500, and an opening 600 at the top 610 of the body 110 which may be sealed by the closure 120.

The closure 120 includes a tab 170 which is movably coupled by a hinge 180 to the lid 130. The tab 170 has an opening or hole 620 formed therein for receiving a compressible head 161 of a pin 160 having a shaft 162 that is mounted on the ring 150 over an opening or slot 400 formed therein for receiving the leading edge 171 of the tab 170 and a portion of the tab 170 itself.

Figures 9, 10, 11, 12:
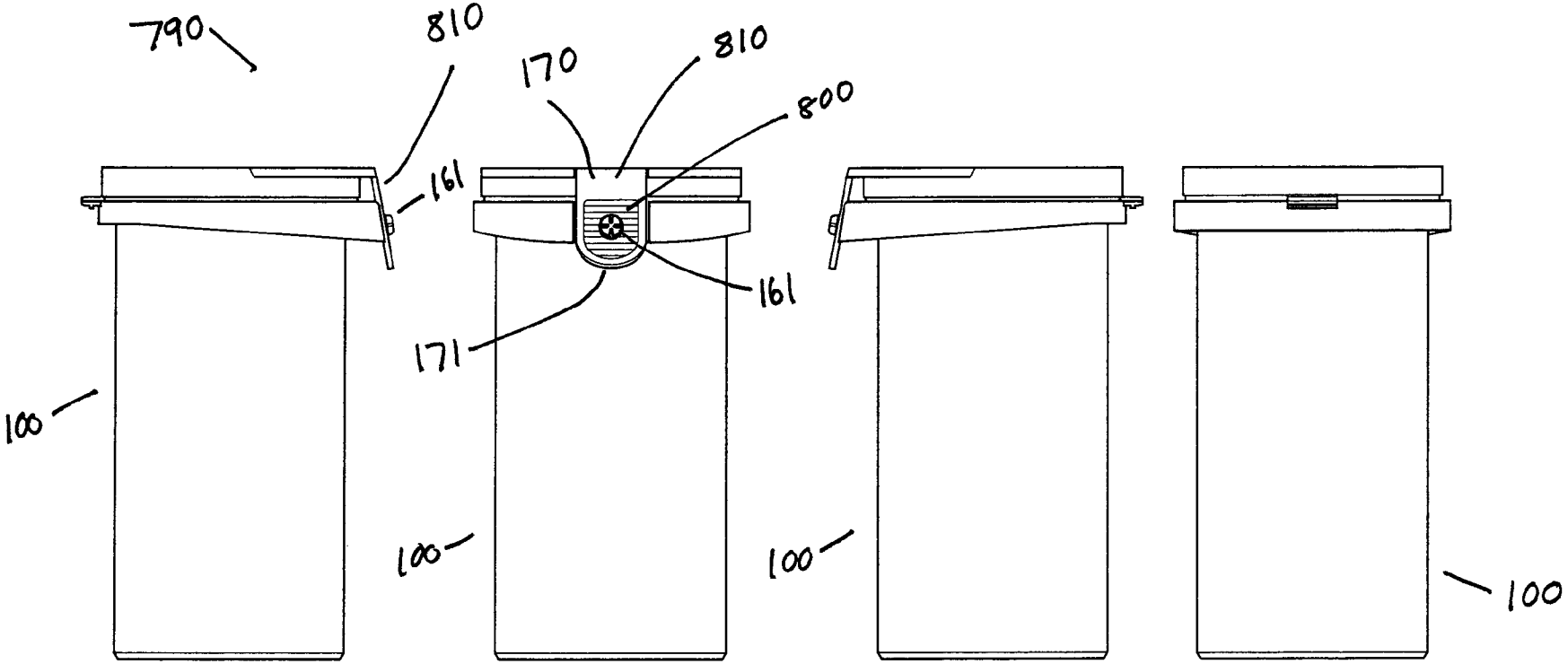
FIG. 9 is a left side view illustrating the container of FIG. 1 with its lid in a held closed position in accordance with an embodiment of the invention.
FIG. 10 is a front view illustrating the container of FIG. 9 in accordance with an embodiment of the invention.
FIG. 11 is a right side view illustrating the container of FIG. 9 in accordance with an embodiment of the invention.
FIG. 12 is a rear view illustrating the container of FIG. 9 in accordance with an embodiment of the invention.
Figure 16:
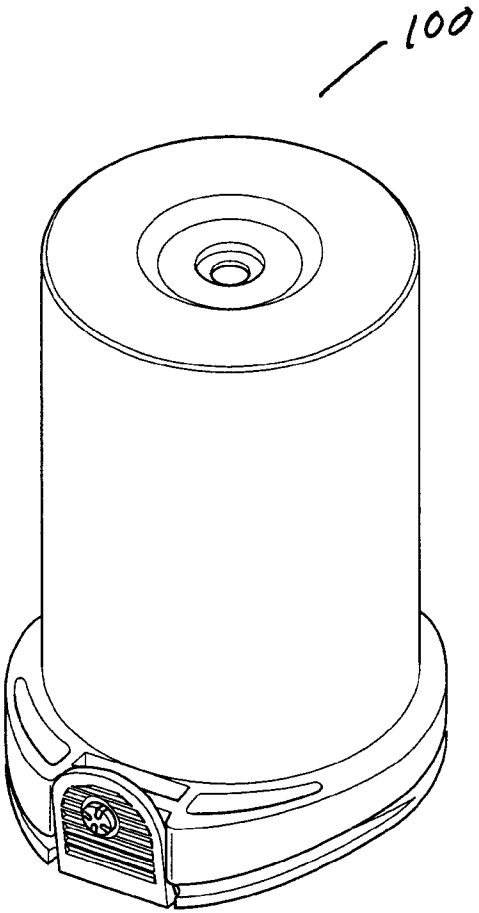
FIG. 16 is a bottom perspective view illustrating the container of FIG. 9 in accordance with an embodiment of the invention.
Figure 15:
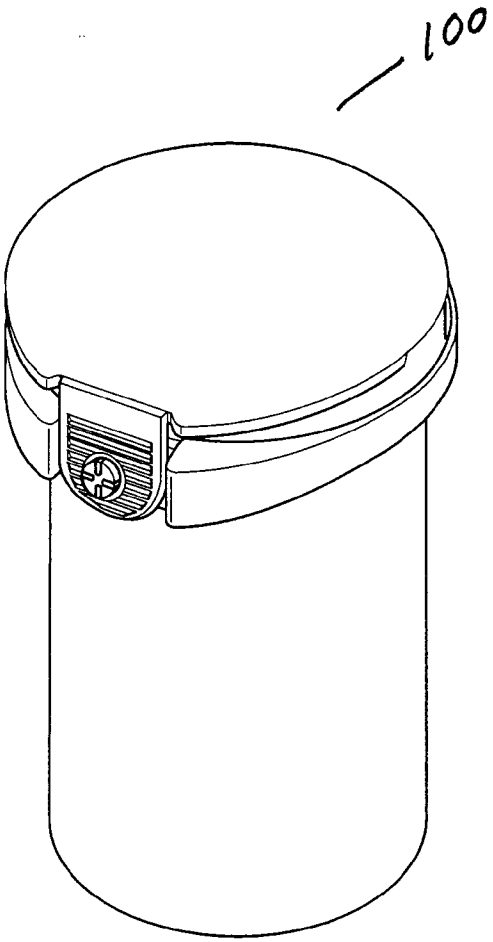
FIG. 15 is a top perspective view illustrating the container of FIG. 9 in accordance with an embodiment of the invention.
Figure 13:
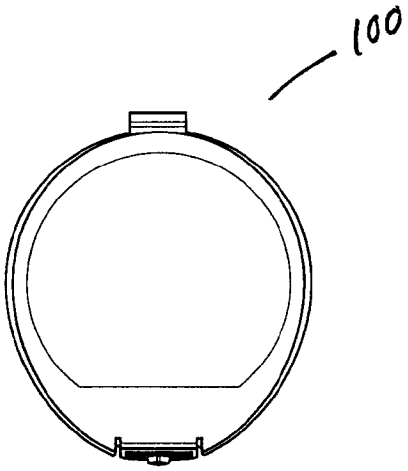
FIG. 13 is a top view illustrating the container of FIG. 9 in accordance with an embodiment of the invention.
Figure 14:
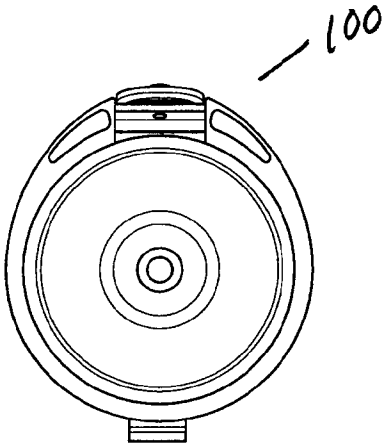
FIG. 14 is a bottom view illustrating the container of FIG. 9 in accordance with an embodiment of the invention.

FIG. 9 is a left side view illustrating the container 100 of FIG. 1 with its lid 130 in a held closed position 790 in accordance with an embodiment of the invention. FIG. 10 is a front view illustrating the container 100 of FIG. 9 in accordance with an embodiment of the invention. FIG. 11 is a right side view illustrating the container 100 of FIG. 9 in accordance with an embodiment of the invention. FIG. 12 is a rear view illustrating the container 100 of FIG. 9 in accordance with an embodiment of the invention. FIG. 13 is a top view illustrating the container 100 of FIG. 9 in accordance with an embodiment of the invention. FIG. 14 is a bottom view illustrating the container 100 of FIG. 9 in accordance with an embodiment of the invention. FIG. 15 is a top perspective view illustrating the container 100 of FIG. 9 in accordance with an embodiment of the invention. And, FIG. 16 is a bottom perspective view illustrating the container 100 of FIG. 9 in accordance with an embodiment of the invention.

From the opened position 190 shown in FIG. 1, the lid 130 of the closure 120 may be moved to the held closed position 790 shown in FIG. 9 by operation of the hinges 140 and 180.

In moving to the held closed position 790, the pin head 161 compresses to pass through the hole 620 formed in the tab 170 after which the pin head 161 expands to (or near to) its original size to hold the lid 130 closed, the shaft 162 of the pin 160 having a smaller diameter than that of the pin head 161. According to one embodiment, grooves or notches 163 formed in the pin head 161 allow the pin head 161 to compress to pass through the hole 620 formed in the tab 170. The pin head 161 may be tapered to allow it to more easily pass through the hole 620 formed in the tab 170. The lid 130 may engage the top portion of the side wall 200 (i.e., the portion of the side wall 200 above the ring 150) in the closed position 790 so as to render the container 100 at least partially air and/or water tight.

Figures 17, 18, 19, 20:
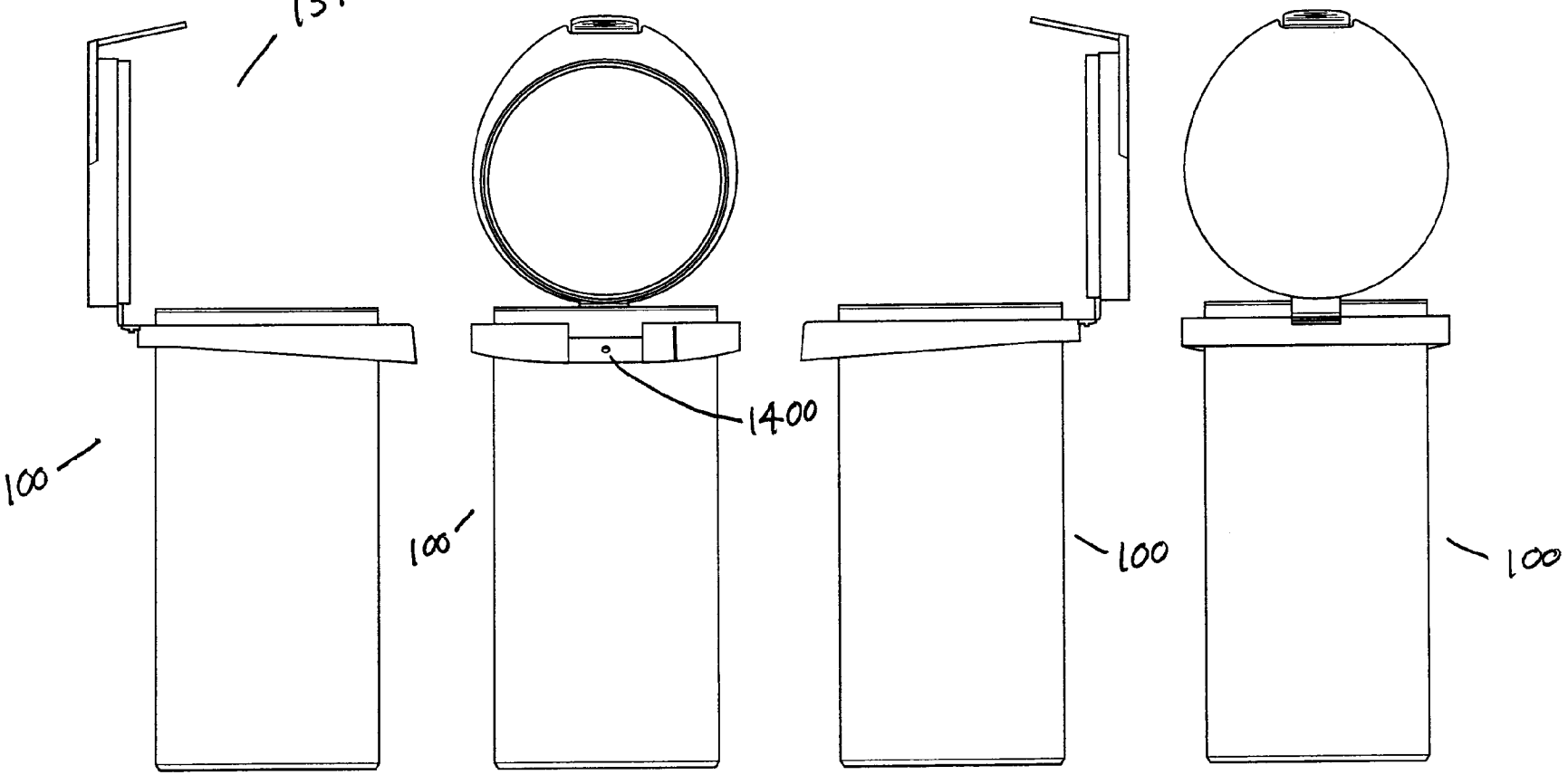
FIG. 17 is a left side view illustrating the container of FIG. 1 with its lid in an opened position with pin detached in accordance with an embodiment of the invention.
FIG. 18 is a front view illustrating the container of FIG. 17 in accordance with an embodiment of the invention.
FIG. 19 is a right side view illustrating the container of FIG. 17 in accordance with an embodiment of the invention.
FIG. 20 is a rear view illustrating the container of FIG. 17 in accordance with an embodiment of the invention.
Figure 21:
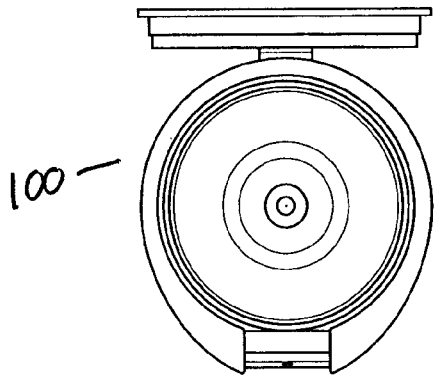
FIG. 21 is a top view illustrating the container of FIG. 17 in accordance with an embodiment of the invention.
Figure 23:
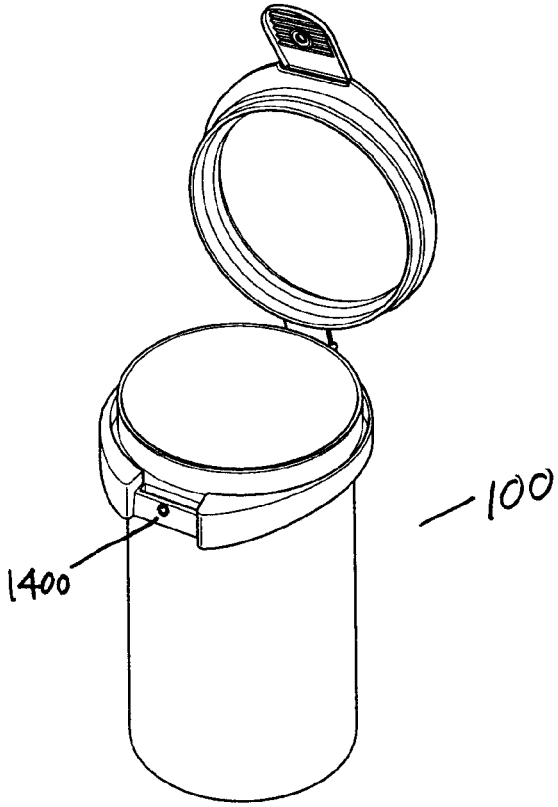
FIG. 23 is a top perspective view illustrating the container of FIG. 17 in accordance with an embodiment of the invention.
Figure 22:
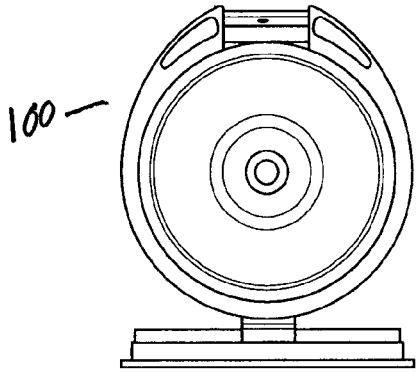
FIG. 22 is a bottom view illustrating the container of FIG. 17 in accordance with an embodiment of the invention.
Figure 24:
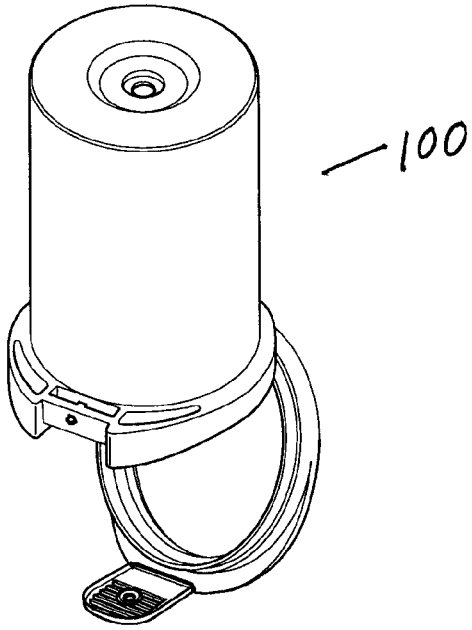
FIG. 24 is a bottom perspective view illustrating the container of FIG. 17 in accordance with an embodiment of the invention.

FIG. 17 is a left side view illustrating the container 100 of FIG. 1 with its lid 130 in an opened position 1390 with pin 160 detached in accordance with an embodiment of the invention. FIG. 18 is a front view illustrating the container 100 of FIG. 17 in accordance with an embodiment of the invention. FIG. 19 is a right side view illustrating the container 100 of FIG. 17 in accordance with an embodiment of the invention. FIG. 20 is a rear view illustrating the container 100 of FIG. 17 in accordance with an embodiment of the invention. FIG. 21 is a top view illustrating the container 100 of FIG. 17 in accordance with an embodiment of the invention. FIG. 22 is a bottom view illustrating the container 100 of FIG. 17 in accordance with an embodiment of the invention. FIG. 23 is a top perspective view illustrating the container of FIG. 17 in accordance with an embodiment of the invention. And, FIG. 24 is a bottom perspective view illustrating the container of FIG. 17 in accordance with an embodiment of the invention.

From the held closed position 790 shown in FIG. 9, the lid 130 of the closure 120 may be moved to the opened (e.g., re-opened) position 1390 shown in FIG. 17 by operation of the hinges 140 and 180.

In moving to the opened position 1390 from the held closed position 790, the pin 160 is removed, broken away, or detached from the ring 150 at the base 164 of the pin shaft 163 by lifting of the tab 170. The pin shaft 162 may be friction mounted in an opening or hole 1400 formed in the ring 150 to facilitate the removal, breaking away, or detachment of the pin 160 upon lifting of the tab 170. Alternatively, the pin 160 may be a molded feature of the ring 150 or may be integral with the ring 150. After breaking away, the pin 160 may be discarded. A container 100 with its pin 160 removed indicates that it has been re-opened. In this way, the pin 160 acts as a tamper-indicator or tamper-indicating mechanism.

Figures 25, 26, 27, 28:
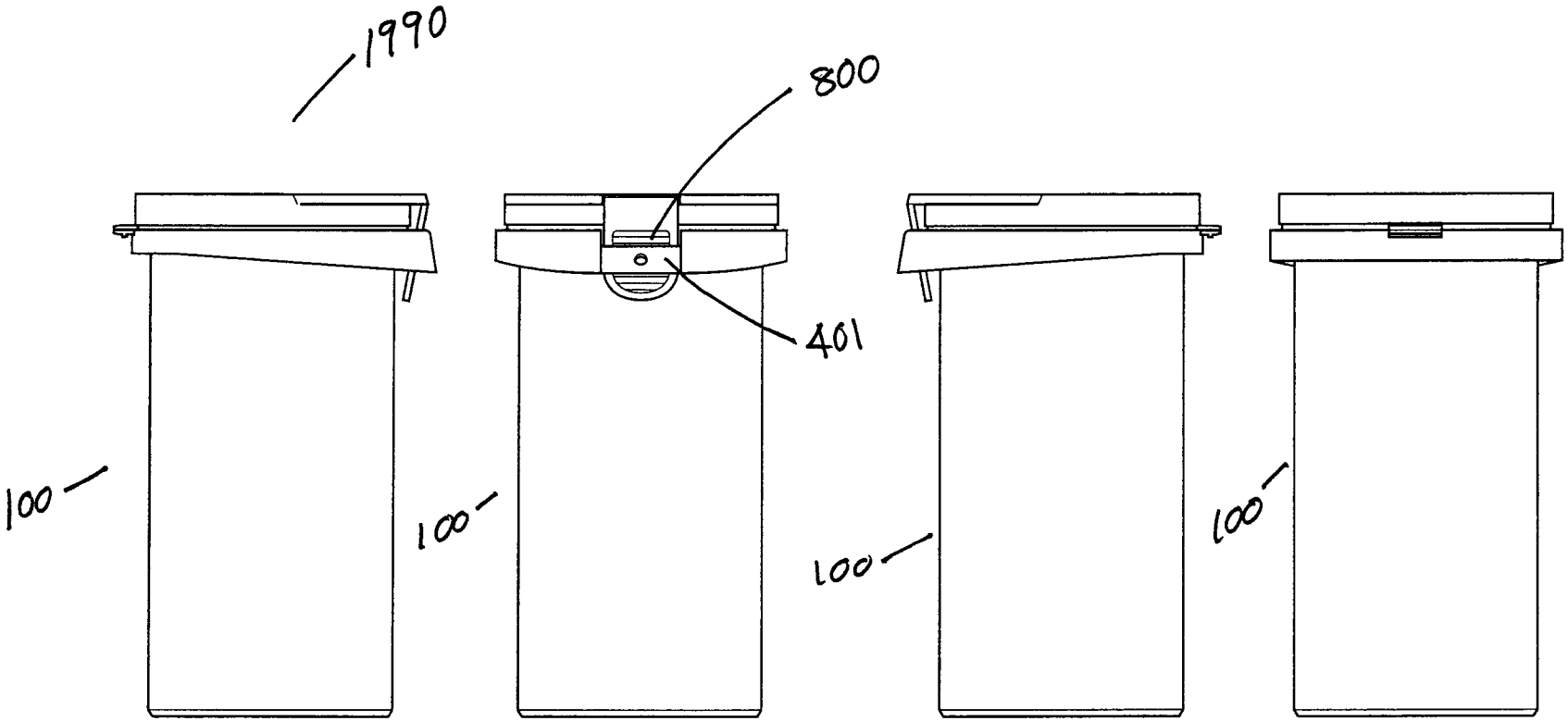
FIG. 25 is a left side view illustrating the container of FIG. 1 with its lid in a locked closed position with pin detached in accordance with an embodiment of the invention.
FIG. 26 is a front view illustrating the container of FIG. 25 in accordance with an embodiment of the invention.
FIG. 27 is a right side view illustrating the container of FIG. 25 in accordance with an embodiment of the invention.
FIG. 28 is a rear view illustrating the container of FIG. 25 in accordance with an embodiment of the invention.
Figure 32:
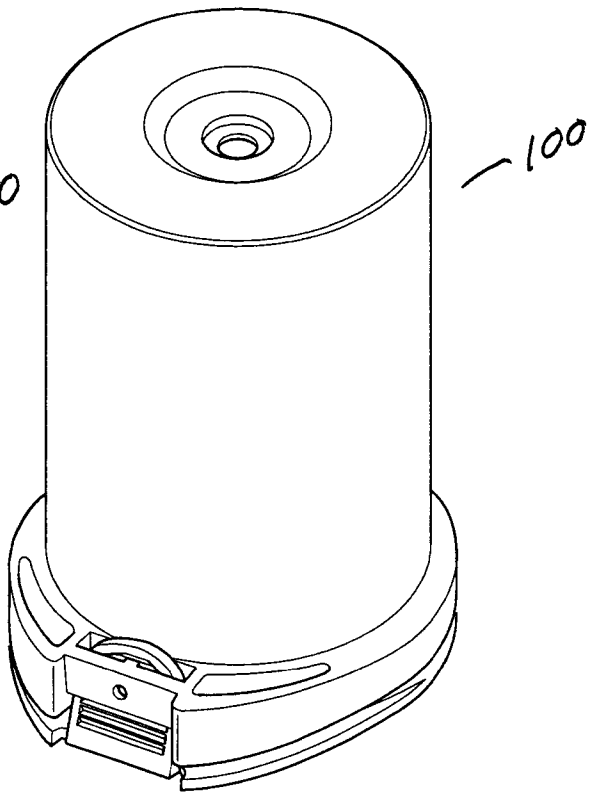
FIG. 32 is a bottom perspective view illustrating the container of FIG. 25 in accordance with an embodiment of the invention.
Figure 31:
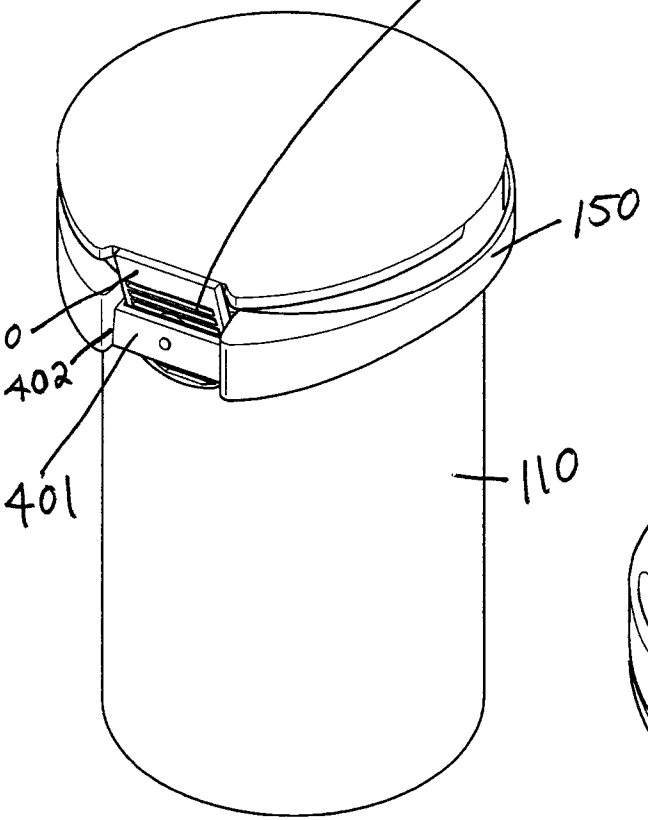
FIG. 31 is a top perspective view illustrating the container of FIG. 25 in accordance with an embodiment of the invention.
Figure 29:
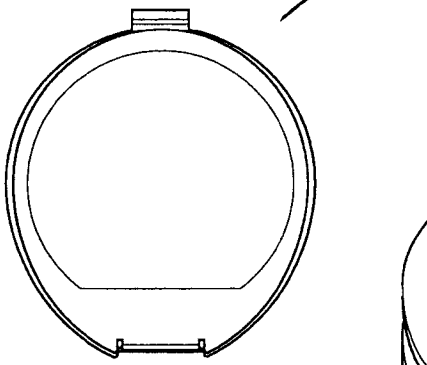
FIG. 29 is a top view illustrating the container of FIG. 25 in accordance with an embodiment of the invention.
Figure 30:
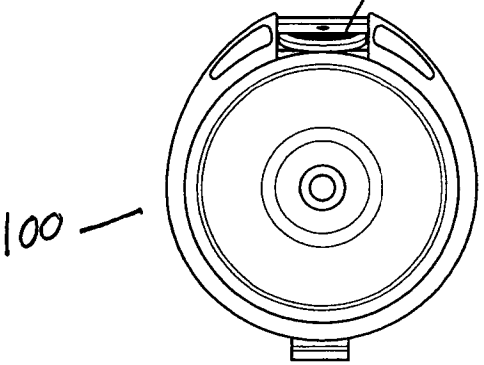
FIG. 30 is a bottom view illustrating the container of FIG. 25 in accordance with an embodiment of the invention.

FIG. 25 is a left side view illustrating the container 100 of FIG. 1 with its lid 130 in a locked closed position 1990 with pin 160 detached in accordance with an embodiment of the invention. FIG. 26 is a front view illustrating the container 100 of FIG. 25 in accordance with an embodiment of the invention. FIG. 27 is a right side view illustrating the container 100 of FIG. 25 in accordance with an embodiment of the invention. FIG. 28 is a rear view illustrating the container 100 of FIG. 25 in accordance with an embodiment of the invention. FIG. 29 is a top view illustrating the container 100 of FIG. 25 in accordance with an embodiment of the invention. FIG. 30 is a bottom view illustrating the container 100 of FIG. 25 in accordance with an embodiment of the invention. FIG. 31 is a top perspective view illustrating the container 100 of FIG. 25 in accordance with an embodiment of the invention. And, FIG. 31 is a bottom perspective view illustrating the container 100 of FIG. 25 in accordance with an embodiment of the invention.

Figure 33:
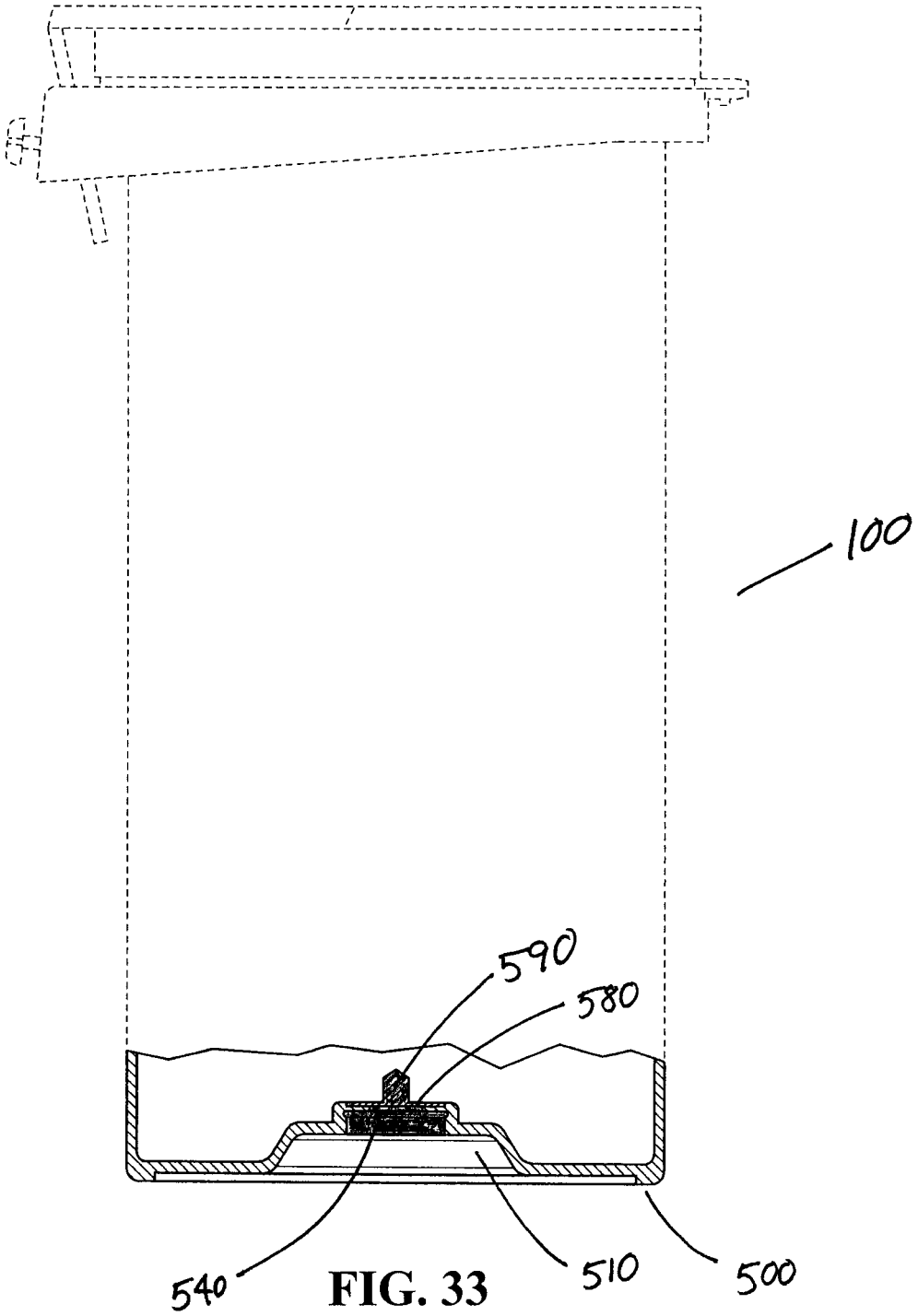
FIG. 33 is cross sectional view illustrating the container of FIG. 1 with its lid in a locked closed position with pin attached and with a test element installed in accordance with an embodiment of the invention.
Figure 34:
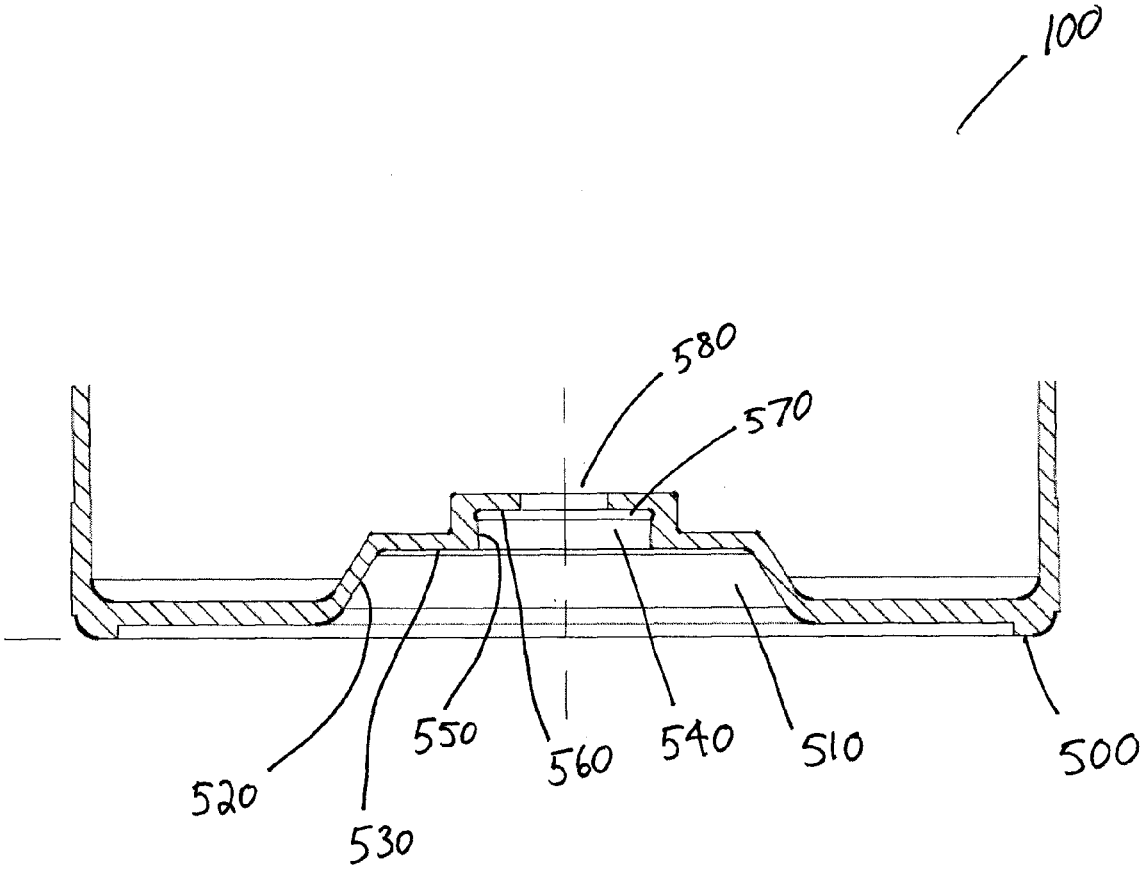
FIG. 34 is a detail view illustrating the base of the container of FIG. 1 without a test element installed in accordance with an embodiment of the invention.
Figure 35:
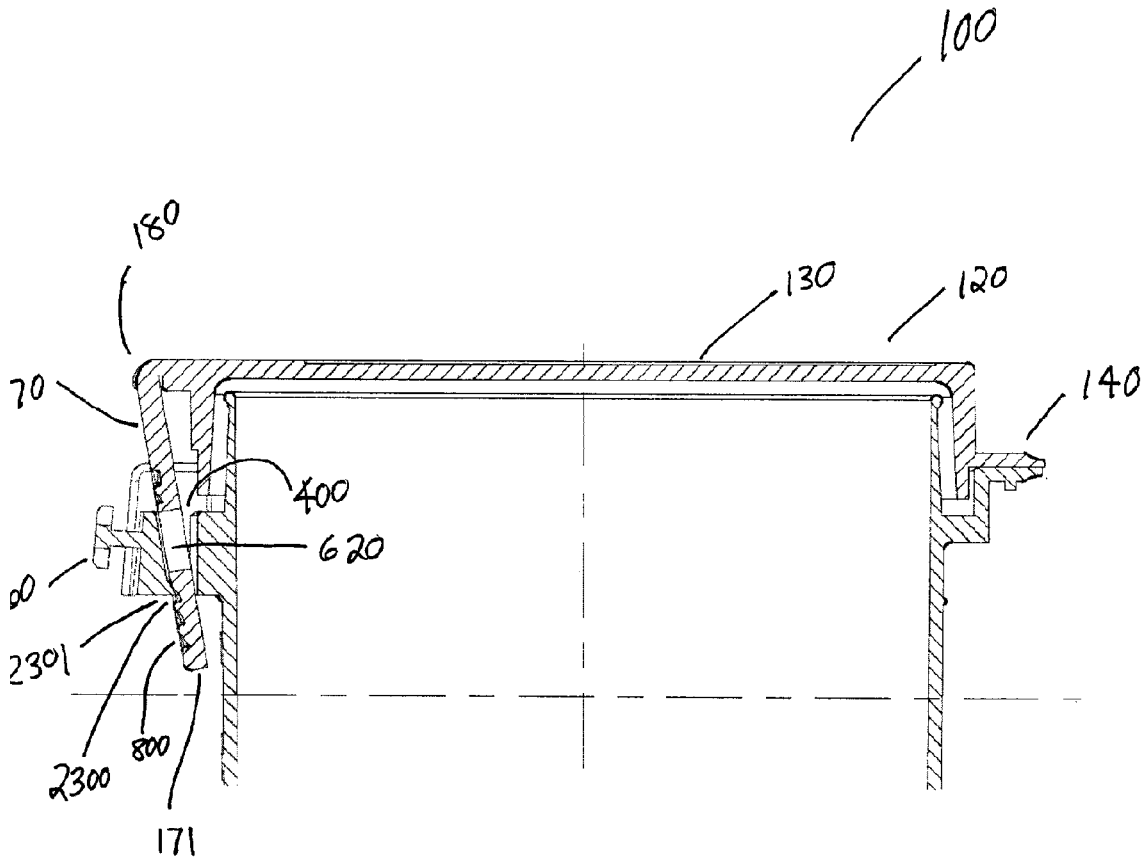
FIG. 35 is a detail view illustrating the closure of the container FIG. 33 in accordance with an embodiment of the invention; and, FIG. 36 is a partial cross sectional view illustrating the container of FIG. 33 installed in test equipment in accordance with an embodiment of the invention.
Figure 36:
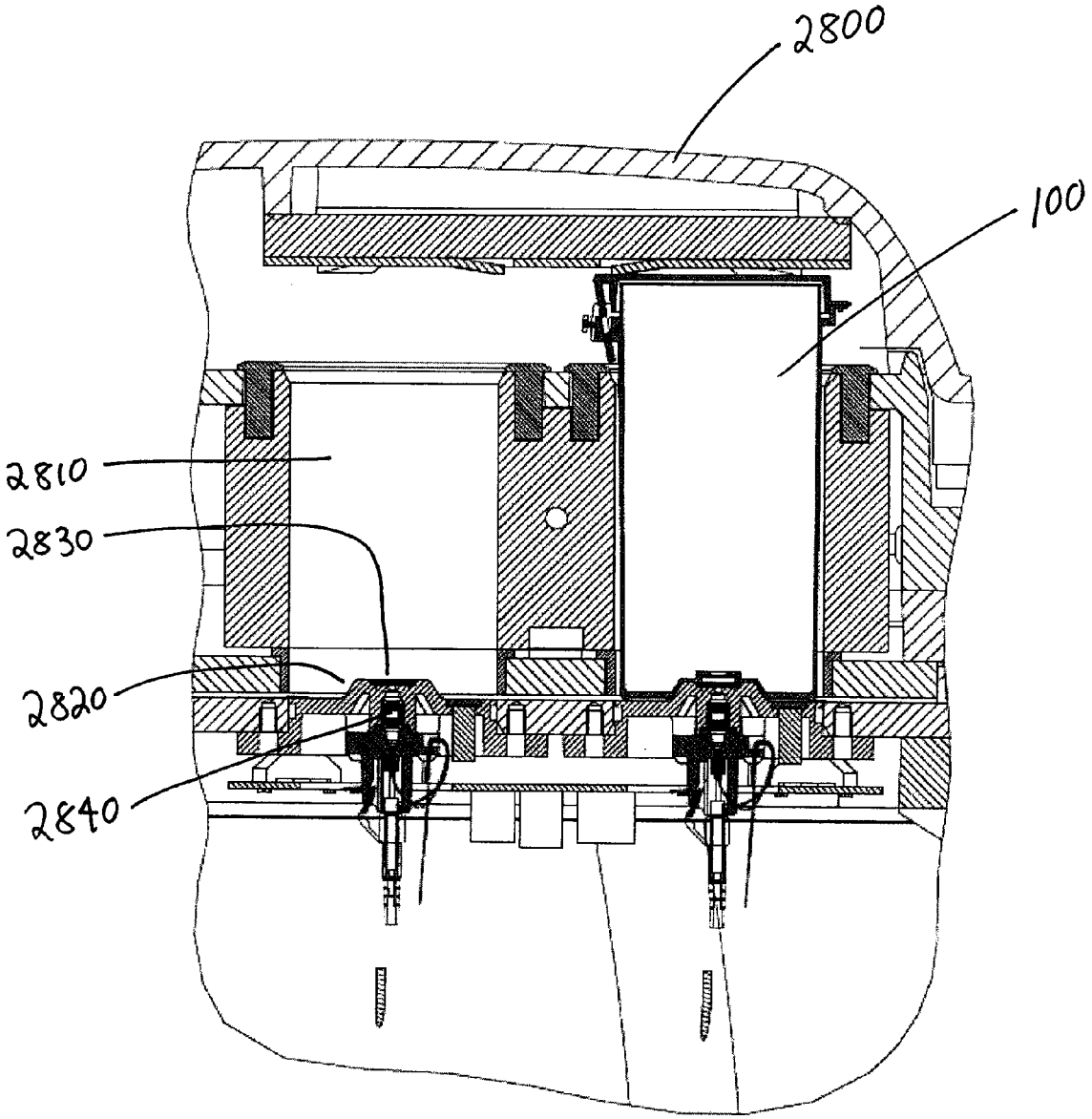

FIG. 33 is cross sectional view illustrating the container 100 of FIG. 1 with its lid 130 in a locked closed position 1990 with pin 160 attached and with a test element 590 installed in accordance with an embodiment of the invention. FIG. 34 is a detail view illustrating the base 500 of the container 100 of FIG. 1 without a test element 590 installed in accordance with an embodiment of the invention. FIG. 35 is a detail view illustrating the closure 120 of the container 100 FIG. 33 in accordance with an embodiment of the invention. And, FIG. 36 is a partial cross sectional view illustrating the container 100 of FIG. 33 installed in test equipment 2800 in accordance with an embodiment of the invention.

From the opened position 1390 shown in FIG. 17, the lid 130 of the closure 120 may be moved to the locked closed position 1990 shown in FIG. 25 by operation of the hinges 140 and 180.

In moving to the locked closed position 1990, the leading edge 171 of the tab 170 is pushed through the slot 400 formed in the ring 170. Grooves or notches 800 formed on the outer surface 810 of the tab 170 engage an inner edge 2300 of the slot 400 formed in the ring 150 to thereby lock the lid 130 closed. The inner edge 2300 may be the lower front edge of the slot 400. The leading edge 171 of the tab 170 may be rounded to allow it to more easily pass through the slot 400 formed in the ring 150. The slot 400 may be tapered to more tightly engage the tab 170 and its notches 800. The inner edge 2300 may have a protrusion or tooth 2301 formed thereon for engaging the grooves or notches 800 formed on the tab 170.

According to one embodiment, the tab 170 may be released from the slot 400 by breaking away a portion 401 of the ring 150 over the slot 400. This portion 401 may have perforations 402 formed therein where it joins the ring 150 to facilitate its breaking away when the tab 170 is pulled away from the body 110 of the container 100.

According to one embodiment, as shown in FIGS. 33 and 35, the pin 160 may remain in place when the closure 120 is in the locked closed (i.e., re-closed) 1990 position. Note that this is not usually the way the container 100 would be used.

According to one embodiment, the closure 120 may be formed or molded on the body 110 with the pin 160 inserted in the hole 620 formed in the tab 170 of the lid 130. That is, the container 100 may be delivered in the held closed position 790 shown in FIGS. 9-16. Such delivery may ensure sterility is maintained inside the container 100 prior to use.

According to one embodiment, the base 500 of the container 100 has a recess 510 formed therein to allow the container 100 to mate with an optical alignment mount (or raised cartridge mount) 2820 in an incubator, receptacle, or test chamber 2810 in external test equipment (or a test system) 2800 for testing a substance held within the container 100. The recess 510 may be circular in shape with an inward sloping wall 520 (e.g., 65 degrees of arc) and flat base 530.

According to one embodiment, an inner recess 540 may be formed in the base 530 to allow for the mounting or insertion of a test element (e.g., a partition element, a siloxane partition element, etc.) 590. An optical window 2830 of the optical alignment mount 2820 of the test equipment 2800 allows light to be transmitted to and received from the test element 590. The inner recess 540 may be circular in shape with a vertical or near vertical wall 550 and a flat base 560.

According to one embodiment, an opening 580 may be formed in the base 560 of the inner recess 540 to allow for the mounting or insertion of the test element 590 to facilitate tests conducted by the test equipment 2800. According to one embodiment, the test element 590 may be co-molded with the container 100. According to another embodiment, the test element 590 may be inserted into the container 100 after molding. According to one embodiment, the inner recess 540 may have an annual bore 570 formed in its wall 550 at or near the base 560. The inner recess 540 may be sized to receive the test element 590 or a portion thereof to facilitate tests conducted by the test equipment 2800.

The recesses 510, 540 formed in the container 100 provide protection for the test element 590 by elevating it above the level of the base 500. As such, the test element 590 is separated from a surface upon which the container 100 may be placed thereby reducing or preventing contamination and/or damage of the test element 590.

The recess 510 formed in the base 500 along with the optical alignment mount 2820 function to align or maintain the container 100 in the test equipment 2800 in an position optimized for the performance of optical devices 2840 (e.g., light emitting diodes ("LEDs"), lens, fiber optics, etc.) contained within the optical alignment mount 2820.

In operation, according to one embodiment, the container 100 is delivered in the held closed position 790. The pin 160 being attached to the container 100 indicates that the container 100 has not been tampered with. The lid 130 is opened and the pin 160 is detached. A sample (e.g., water) is placed in the container 100 along with a substrate that will react with contaminants in the water to produce a detectable product. The lid 130 of the container 100 is then locked closed 1990 by inserting the tab 170 of the lid 130 in the slot 400 formed in the ring 150 of the closure 120. The detectable product is partitioned by the test element (e.g., a partition element, a siloxane partition element, etc.) 590 that has been pre-mounted in the container 100. The container 100 is placed in the test chamber or incubator 2810 within the test equipment 2800 where it is locked in place by mating of the recess 510 formed in the base 100 of the container and the optical alignment mount 2820 formed in the incubator. The test element 590 is illuminated by LEDs within the optical alignment mount 2820 and the presence and amount of the detectable product is determined using optical devices 2840 contained in the optical alignment mount 2820 and in the test equipment 2800.

Thus, according to one embodiment, there is provided a container 100 comprising: a body 110; and, a closure 120; wherein the closure 120 has a lid 130 hinged 140 to a ring 150 mounted on the body 110, the lid 130 moveable from an open position 190, 1390 to a closed position 790, 1990; wherein the lid 130 has a tab 170 hinged 180 thereto for: inserting into and engaging a slot 400 formed in the ring 150 as the lid 130 is moved to the closed position 1990 from the open position 190, 1390 to thereby lock the lid 130 in the closed position 1990; or, receiving and engaging a pin head 161 of a pin 160 mounted on the ring 150 in a hole 620 formed in the tab 170 to thereby hold the lid 130 in the closed position 790, the pin 160 configured to detach from the ring 150 when the tab 170 and lid 130 are returned to the open position 1390. The container 100 may include a recess 510 formed in a base 500 of the body 110 for mating the container 100 with test equipment 2800. The container 100 may include a test element 590 disposed in the recess 510 such that a portion of the test element 590 is in contact with a sample placed in the body 110. The test element 590 may be separated from a surface in contact with the base 500. The test element 590 may be in contact with the test equipment 2800. The contact may include optical communication with the test equipment 2800. The test element 590 may be integrated with material of the container 100. And, the test element 590 may comprise a material different from that of the container 100.

According to another embodiment, there is provided a method for storing a sample in a container 100 having a lid 130, comprising: initially providing the container 100 with the lid 130 in a closed position 790, the container 100 having a first indicator 160 confirming that the lid 130 has not been opened; and, opening the lid 130, placing the sample in the container 100, and closing the lid 130, including causing the first indicator 160 to indicate that the lid 130 has been opened and causing a second indicator 401 to indicate a closed state of the lid 130 after a single opening. The first indicator 160 may be indicative of a condition of an interior of the container 100 prior to opening the lid 130 and the second indicator 401 may be indicative of tampering with the sample. For example, the first indicator 160 may be indicative of a sterile condition of the interior of the container 100.

According to another embodiment, there is provided a method for testing a sample for the presence of a molecule of interest, comprising: combining in the container 100 (described above) the sample and a substance that can react with the molecule of interest to produce an analyte; placing the container 100 in test equipment 2800 such that the test element 590 is in optical communication with the test equipment 2800; and, optically detecting presence of the analyte when it has partitioned into the test element 590; wherein detection of the analyte in the test element 590 indicates presence of the molecule of interest in the sample. The sample and the substance may be combined in the container 100 in a liquid phase and partitioning may include the analyte moving from the liquid phase into the test element 590. The molecule of interest may be an enzyme and the substance may include a substrate for the enzyme. The enzyme may be associated with a microorganism. The microorganism may be a biological contaminant. And, the biological contaminant may be a coliform bacteria.

The above embodiments may contribute to an improved container 100 and closure 120 for a container 100 and may provide one or more advantages. First, the closure 120 of the container 100 allows for secure locking of the container 100 after an initial opening. Second, the pin 160 of the closure 120 provides for a readily apparent tamper indication. Third, the recesses 510, 540 formed in the base 500 of the container 100 provide protection for the test element 590.

The embodiments of the invention described above are intended to be exemplary only. Those skilled in this art will understand that various modifications of detail may be made to these embodiments, all of which come within the scope of the invention.

What is claimed is:

1. A container, comprising:
a body;
a closure comprising a lid hinged to the body, the lid moveable from an open position to a closed position;
a tab hinged to the lid; and
a projection extending from the body, the projection having a slot formed therein and a pin formed thereon;
wherein the tab secures the lid in the closed position according to (i) a first mechanism wherein the tab engages the slot, or (ii) a second mechanism wherein the tab engages a pin head of the pin;
wherein the pin is configured to detach from the projection when the tab and lid are returned to the open position.

2. The container of claim 1, further comprising an inwardly-projecting recess formed in a base of the body that aligns the container with test equipment.

3. The container of claim 2, further comprising a test element disposed in the inwardly-projecting recess.

4. The container of claim 3, wherein at least a portion of the test element is in contact with a sample placed in the body.

5. The container of claim 4, wherein at least a portion of the test element is elevated above an inside surface of the base.

6. The container of claim 3, wherein the inwardly-projecting recess provides optical alignment of the test element with the test equipment.

7. The container of claim 3, wherein the test element is in contact with the test equipment.

8. The container of claim 7, wherein the contact includes optical communication with the test equipment.

9. The container of claim 3, wherein the test element is integrated with material of the container.

10. The container of claim 3, wherein the test element comprises a material different from that of the container.

11. The container of claim 3, wherein the test element comprises a siloxane material.

12. A container, comprising:
a body;
a closure comprising a lid hinged to the body, the lid moveable from an open position to a closed position;
a test element disposed in a base of the body such that at least a portion of the test element is in contact with a sample placed in the body;
a tab hinged to the lid; and
a projection extending from the body, the projection having a slot formed therein and a pin formed thereon;
wherein the tab secures the lid in the closed position according to (i) a first mechanism wherein the tab engages the slot, or (ii) a second mechanism wherein the tab engages a pin head of the pin;
wherein the pin is configured to detach from the projection when the tab and lid are returned to the open position.

13. The container of claim 12, further comprising an inwardly-projecting recess formed in the base of the body that aligns the container with test equipment.

14. The container of claim 12, wherein at least a portion of the test element is elevated above an inside surface of the base.

15. The container of claim 13, wherein the test element is disposed with the inwardly-projecting recess.

16. The container of claim 13, wherein the inwardly-projecting recess provides optical alignment of the test element with the test equipment.

17. The container of claim 16, wherein the test element is in optical communication with the test equipment.

18. The container of claim 12, wherein the test element is integrated with material of the container.

19. The container of claim 12, wherein the test element comprises a material different from that of the container.

20. The container of claim 12, wherein the test element comprises a siloxane material.

* * * * *